US007762511B1

(12) United States Patent
Liebers et al.

(10) Patent No.: US 7,762,511 B1
(45) **Date of Patent: *Jul. 27, 2010**

(54) DISPLAY HANGER FOR NON-PRESCRIPTION READING GLASSES AND CASE

(75) Inventors: Steven B. Liebers, Norristown, PA (US); Kurt Shenk, Lansdale, PA (US)

(73) Assignee: Diversified Products, Inc., Collegeville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/331,265

(22) Filed: Dec. 9, 2008

Related U.S. Application Data

(63) Continuation-in-part of application No. 11/924,226, filed on Oct. 25, 2007, now Pat. No. 7,523,909.

(51) Int. Cl.
*A47F 5/00* (2006.01)

(52) U.S. Cl. ..... 248/309.1; 248/902; 206/5

(58) Field of Classification Search ..... 248/309.1, 248/902, 225.11, 225.21, 224.8, 690, 300, 248/301; 206/5.6, 806, 486; 24/3.3; D9/457, D9/722; 351/158
See application file for complete search history.

(56) References Cited

U.S. PATENT DOCUMENTS

| | | | |
|---|---|---|---|
| 646,638 | A | 4/1900 | Cutler |
| 1,333,765 | A | 3/1920 | Moore |
| 2,656,917 | A | 10/1953 | Hollis |
| 3,136,409 | A | 6/1964 | Schumann |
| 3,329,386 | A | 7/1967 | Rosen |
| 3,370,733 | A | 2/1968 | Giesler |
| 3,819,033 | A | 6/1974 | Hueber |
| 3,884,443 | A | 5/1975 | McMaster |
| 3,885,667 | A | 5/1975 | Spiegel et al. |
| 4,132,309 | A | 1/1979 | Shaylor |
| 4,257,522 | A | 3/1981 | Thorneburg |
| D289,016 | S | 3/1987 | Campbell |
| D308,080 | S | 5/1990 | Sachs |
| 5,000,410 | A | 3/1991 | Beavers |
| 5,002,187 | A | 3/1991 | Rysner et al. |
| 5,044,773 | A | 9/1991 | Harms et al. |
| 5,046,696 | A | 9/1991 | Lee |

(Continued)

OTHER PUBLICATIONS

Five (5) photographs (identified1 through 5) of the "Slim-Line Ultra Thin Readers" packaging.

*Primary Examiner*—Anita M King
(74) *Attorney, Agent, or Firm*—Caesar, Rivise, Bernstein, Cohen & Pokotilow, Ltd.

(57) ABSTRACT

A hanger system for holding glasses and a case includes a hanger made from a thin web. A flexible strip is connected to the main body of the web at a hinge point where the strip flexes away from the body. The strip is connected to an arm of the glasses with a fastener, such as a tie wrap. A portion of the body slidably engages the case, wherein the body is located substantially inside the case and the flexible strip is flexed away from the body at the hinge point and located outside the case. An upper edge of the case is located at the hinge point such that the body is inside and the strip is outside the case. The pair of arms opens to accommodate a user trying on the glasses with the case attached.

18 Claims, 7 Drawing Sheets

U.S. PATENT DOCUMENTS 5,129,617 A 7/1992 MacWilliamson
5,144,345 A 9/1992 Nyman
5,340,074 A 8/1994 Porcaro et al.
D357,278 S 4/1995 Turney
5,423,505 A 6/1995 David
5,477,964 A 12/1995 Hart
5,484,056 A 1/1996 Wood
5,559,567 A 9/1996 Kolton et al.
5,636,821 A 6/1997 Davies
D381,046 S 7/1997 Hiers et al.
5,672,238 A 9/1997 Samuelson
5,699,907 A 12/1997 Langenstuck
5,699,990 A 12/1997 Seach
5,743,403 A 4/1998 Crysdale
5,791,470 A * 8/1998 Usui ..... 206/362.4
5,791,608 A 8/1998 Nielsen et al.
5,823,503 A 10/1998 Wasserman
5,913,416 A 6/1999 Rothan
RE36,258 E 7/1999 Coward et al.
6,032,793 A 3/2000 Oakley
D431,460 S 10/2000 Nichol
6,575,295 B2 6/2003 Mayfield
6,581,760 B1 6/2003 Robertson
D478,510 S 8/2003 Kumakura
6,648,132 B1 11/2003 Smouha
6,808,069 B1 * 10/2004 O'Toole ..... 206/362.3
D497,800 S 11/2004 Trettin
6,827,210 B2 12/2004 Chen
6,994,307 B2 * 2/2006 Curtsinger et al. ..... 248/317
7,055,680 B2 6/2006 Liebers
D527,634 S 9/2006 Liebers
D545,675 S 7/2007 Liebers
2002/0189955 A1 12/2002 Waters

* cited by examiner

FIG.3
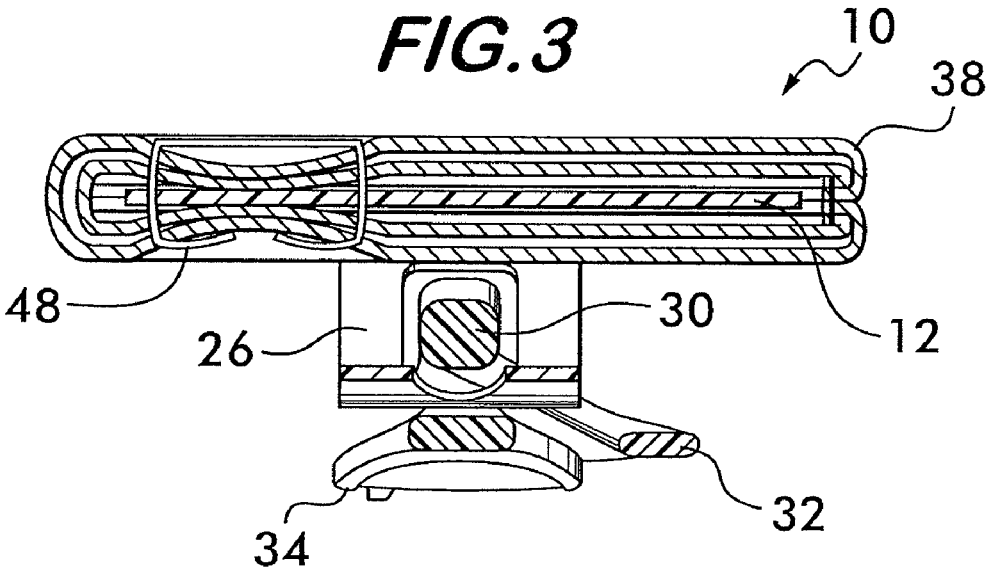
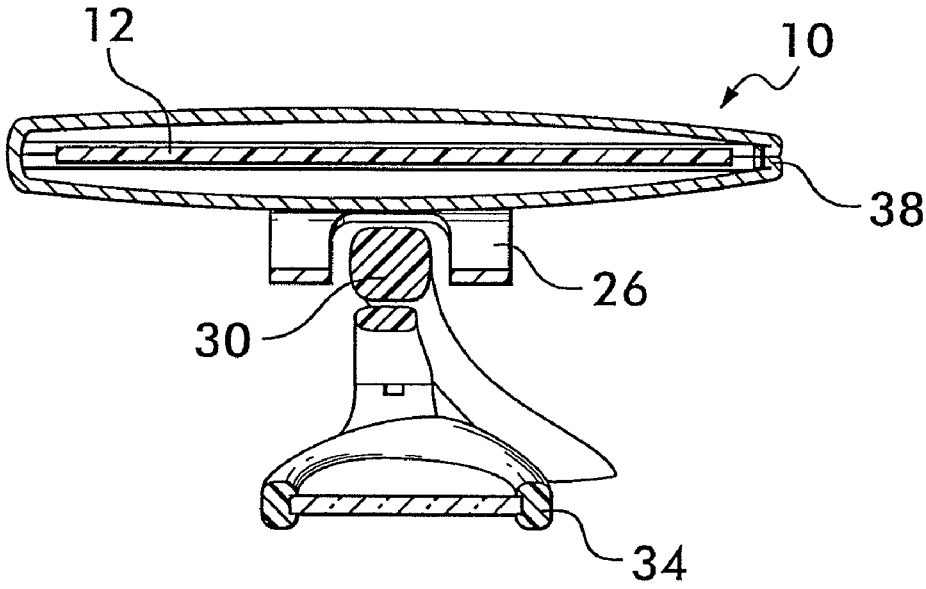
FIG.4

DISPLAY HANGER FOR NON-PRESCRIPTION READING GLASSES AND CASE

CROSS-REFERENCES TO RELATED APPLICATIONS

This is continuation-in-part application of U.S. application Ser. No. 11/924,226, filed Oct. 25, 2007, entitled Display Hanger for Non-Prescription Reading Glasses and Case, pending.

BACKGROUND OF THE INVENTION

This invention relates to a display hanger for non-prescription reading glasses and an accompanying case for use on a hanging type display stand.

Various display hangers exist in the prior art for hanging various articles, such as hand tools and the like. For example, U.S. Pat. No. 5,484,056 (Wood) teaches a display hanger for suspending an article such as a screwdriver. A special elastomeric grommet is used to hang the tool.

Additionally, U.S. Pat. No. 3,884,443 (McMaster) teaches a pressure-sensitive hanger for small articles such as merchandise packages, wall packages and the like that can be hung on display rods or hooks. This invention is directed to a universal hanger that is applied with adhesive to a small item. Here, a means to prevent peeling of the hanger from the product to which it is secured is included.

Various eyeglass holders are also known. For example, U.S. Pat. No. 5,046,696 (Lee) teaches a holder for eyeglasses which accepts a temple portion of an eyeglass frame for supporting eyeglasses in a vertical position. The holder may be mounted, for example, in an automobile, boat or convenient location in a home. The design includes a planar first member and a second member integral to the first which protrudes outwardly. An opening between the first and second members accepts the temple of the eyeglass frame. An adhesive is applied to a surface of the first member for adhesion of the device to another surface.

U.S. Pat. Nos. D545,675 (Liebers), D527,634 (Liebers), and 7,055,680 (Liebers) disclose a hanger for a case holding a pair of glasses. The hanger includes a web of flexible material having an elongate main body portion having an upper end and a lower end and a pair of tabs extending from the lower end of the main body portion. The tabs encircle the case. An aperture adjacent to the upper end of the main body portion receives a support for hanging the hanger, thereby holding the case.

However, to this point, a very simple and inexpensive hanger for a glasses and a glasses case has not been known that allows a user to try on the glasses such that the glasses remain attached to the case by the hanger such that a the matched pair of glasses and case always remain together, thereby avoiding loss, mismatched glasses and cases, etc.

All references cited herein are incorporated herein by reference in their entireties.

BRIEF SUMMARY OF THE INVENTION

The present invention is directed to a hanger system for a pair of glasses having a frame having a pair of arms, and a case. The system includes a hanger constructed from a thin web having a main body having a top edge, a bottom edge and two side edges and a flexible strip integral to the thin web. The flexible strip is located generally midway between the two side edges and is connected to the main body at a hinge point.

The flexible strip is adapted to flex away from the main body at the hinge point. The flexible strip is connected to an arm of the pair of glasses with a fastener. A portion of the main body slidably engages the case, wherein the main body is located substantially inside the case and the flexible strip is flexed away from the main body at the hinge point and located outside the case. An upper edge of the case is located generally at the hinge point. The pair of arms of the frame is openable to accommodate a user trying on the pair of glasses with the case remaining attached to the pair of glasses by the hanger.

The flexible strip may have an upper aperture and a lower aperture for receiving one of the pair of arms. The case may be attached to the main body of the hanger by a fastener. The fastener may be a staple. A top aperture for receiving a hook may be located adjacent to the top edge and generally midway between the two side edges. The case may be a bag constructed from a flexible material. The flexible strip may be connected to an arm of the pair of glasses with a fastener such as a tie wrap, wherein the tie wrap is wrapped around the arm of the pair of glasses and is attached using two apertures in the flexible strip. A security tag may be attached to the hanger.

In a second embodiment of the present invention, a hanger for holding a pair of glasses having a frame having a pair of arms and a case is provided that includes a thin web having a main body having a top edge, a bottom edge and two side edges and a flexible strip integral to the thin web. The flexible strip is located generally midway between the two side edges and connected to the main body at a hinge point. The flexible strip is adapted to flex away from the main body at the hinge point and is adapted to attach to an arm of the pair of glasses. The flexible strip is connected to an arm of the pair of glasses with a fastener. A portion of the main body is adapted to slidably engage the case, wherein the main body is located substantially inside the case and the flexible strip is flexed away from the main body at the hinge point and located outside the case. An upper edge of the case is located generally at the hinge point. In use, the pair of arms of the frame is openable to accommodate a user trying on the pair of glasses with the case remaining attached to the pair of glasses by the hanger.

The flexible strip may have an upper aperture and a lower aperture for receiving one of the pair of arms. A top aperture for receiving a hook may be included, located adjacent to the top edge and generally midway between the two side edges. The flexible strip may be connected to an arm of the pair of glasses with a fastener such as a tie wrap, wherein the tie wrap is wrapped around the arm of the pair of glasses and is attached using two apertures in the flexible strip.

In another embodiment of the present invention, a hanger system and a pair of glasses having a frame having a pair of arms and a case is provided that includes a hanger constructed from a thin web that includes a main body and a flexible strip integral to the thin web. The flexible strip is connected to the main body at a hinge point and is adapted to flex away from the main body at the hinge point. The flexible strip is connected to an arm of the pair of glasses. a portion of the main body slidably engages the case, wherein the flexible strip is flexed away from the main body at the hinge point and located outside the case. The pair of arms of the frame is openable to accommodate a user trying on the pair of glasses with the case remaining attached to the pair of glasses by the hanger.

The flexible strip may be connected to an arm of the pair of glasses with a fastener such as a tie wrap. The tie wrap may be wrapped around the arm of the pair of glasses and is attached using two apertures in the flexible strip. Other fasteners may be used such as a wire tie, adhesive, or the like. The hanger may have a security tag attached thereto.

BRIEF DESCRIPTION OF SEVERAL VIEWS OF THE DRAWINGS

The invention will be described in conjunction with the following drawings in which like reference numerals designate like elements and wherein:

FIG. 3 is a top, cross-sectional view of the display hanger system for non-prescription reading glasses and case of FIG. 1, taken substantially along lines 3-3 of FIG. 2, shown having the glasses and case attached thereto;

FIG. 4 is a top, cross-sectional view of the display hanger system for non-prescription reading glasses and case of FIG. 1, taken substantially along lines 4-4 of FIG. 2, shown having the glasses and case attached thereto;

DETAILED DESCRIPTION OF THE INVENTION

Figure 1:
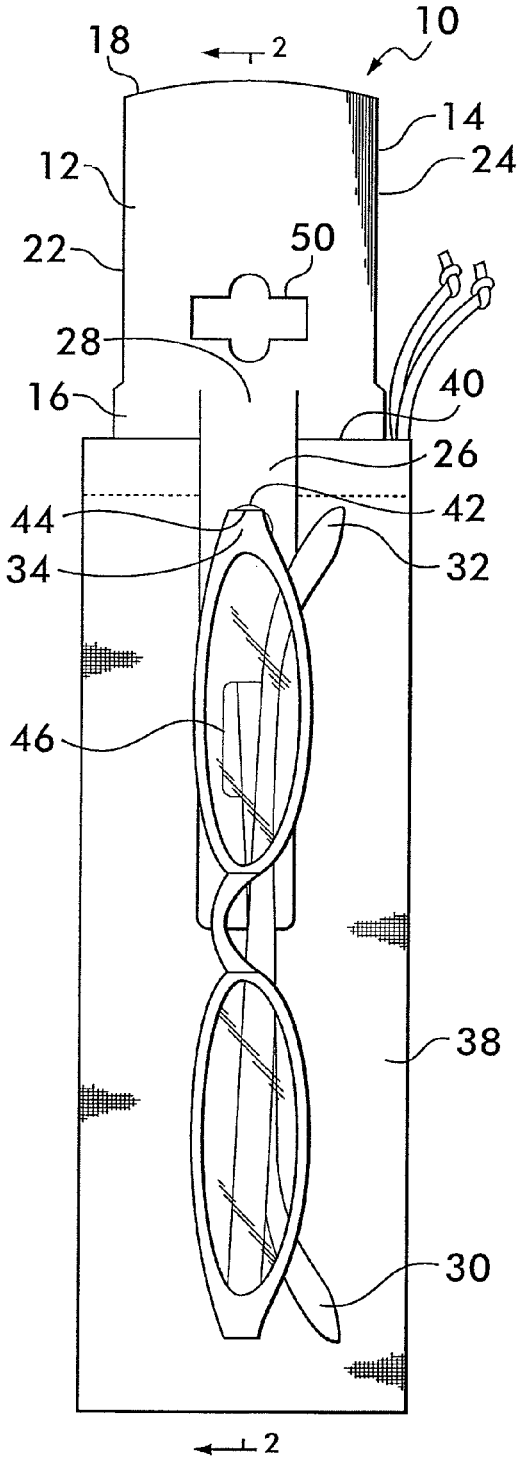
FIG. 1 is a front, elevation view of a display hanger system for non-prescription reading glasses and case in accordance with a preferred embodiment of the present invention, shown having the glasses and case attached thereto.

The invention will be illustrated in more detail with reference to the following embodiment, but it should be understood that the present invention is not deemed to be limited thereto.

Referring now to the drawings, wherein like part numbers refer to like elements throughout the several views, there is shown in FIGS. 1-5, a hanger system 10 for holding a pair of glasses and a case in accordance with a preferred embodiment of the present invention. The hanger system 10 includes a hanger 12 constructed from a thin web 14 of, for example, polyvinylchloride. Paper, cardboard or nearly any other suitable thin flexible material may be suitable.

Figure 5:
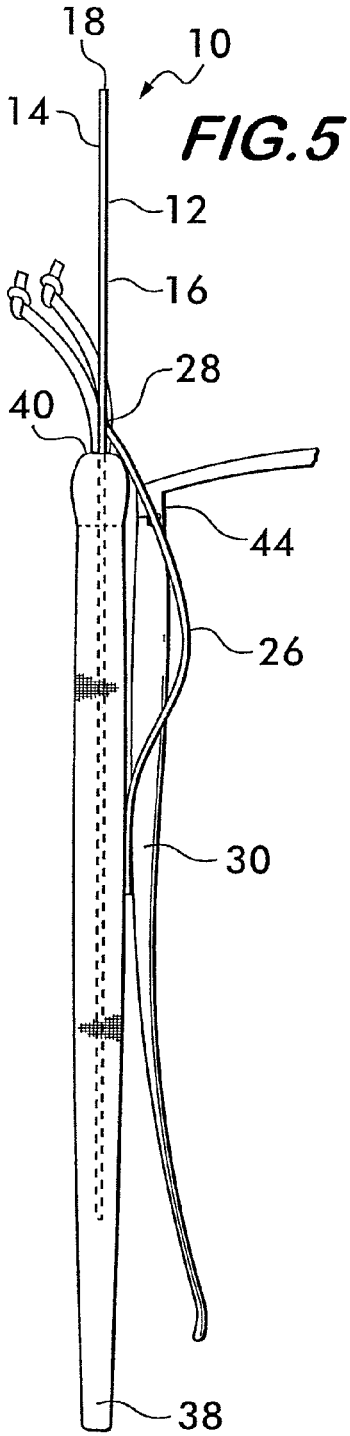
FIG. 5 is a side, elevation view of the display hanger system for non-prescription reading glasses of FIG. 1, shown having the glasses and case attached thereto.
Figure 6:
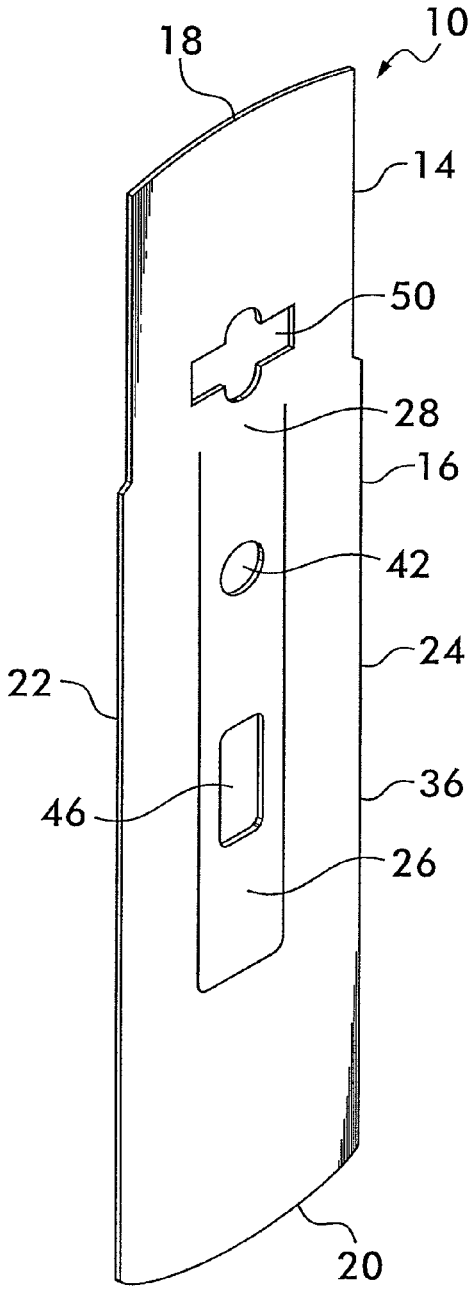
FIG. 6 is an isometric view of a display hanger of the display hanger system for non-prescription reading glasses of FIG. 1.

As can be seen in FIGS. 1-5 and more clearly in FIG. 6 (which shows the hanger 12 itself), the hanger 12 has a main body 16 having a top edge 18, a bottom edge 20 and two side edges 22, 24. A flexible strip 26, integral to the thin web 14, is provided which is located generally midway between the two side edges 22, 24 and is connected to the main body 16 at a hinge point 28. It is noted that the natural flex of the flat web 14 provides the hinge point 28. No actual mechanical hinge point or even a score line or the like is necessary. The flexible strip 26 is capable of flexing away from the main body 16 at the hinge point 28, as best shown, for example, in FIGS. 2 and 5. The flexible strip 26 is connected to one of the two temple arms 30, 32 of the pair of glasses 34, as will be described in further detail below.

Figure 2:
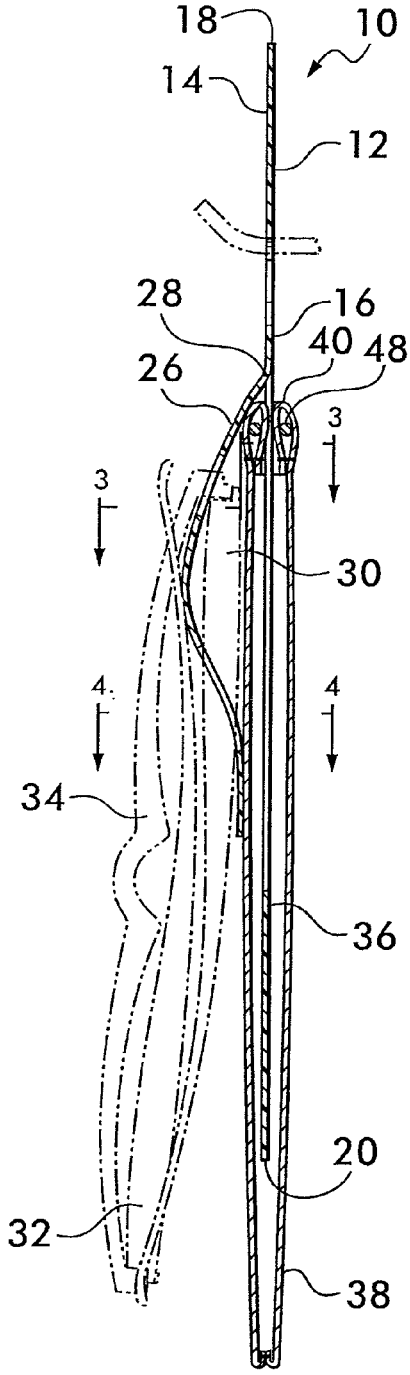
FIG. 2 is side, cross-sectional view of the display hanger system for non-prescription reading glasses and case of FIG. 1, taken substantially along lines 2-2 of FIG. 1, shown having the glasses and case attached thereto.

As can be seen in FIGS. 1-5, a portion 36 of the main body 16 of the hanger 12 is slid into the case 38. In this preferred embodiment, the case 38 is a soft cloth bag, constructed from a fabric and having a drawstring. However, it is within the desired scope of the present invention to use other types of cases and cases of different materials, for example, molded plastic, formed metal, flexible vinyl, and the like. As stated above, the portion 36 of the main body 16 is located substantially inside the case 38. However, the flexible strip 26 is flexed away from the main body 16 at the hinge point 28 such that the flexible strip 26 is located substantially outside of the case 38. As best seen in FIGS. 2 and 5, an upper edge 40 of the case 38 is located generally at the hinge point 28.

Figure 7:
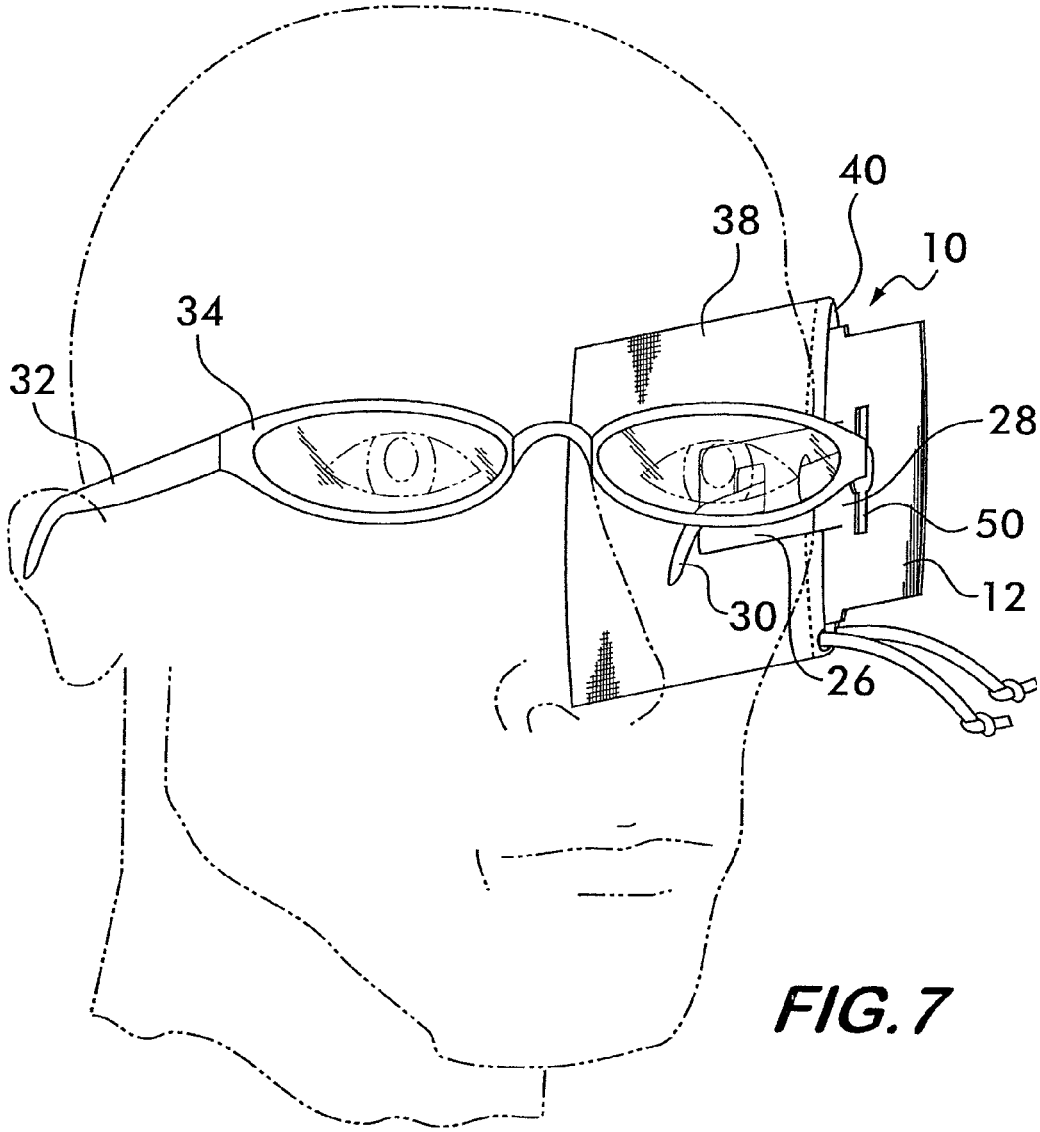
FIG. 7 is an isometric view of the display hanger system for non-prescription reading glasses of FIG. 1, shown in an open condition for testing by a user.

In use, as best seen in FIG. 7, a user walks up to a display having numerous styles and powers of non-prescription reading glasses using the hanger system for holding a pair of glasses and a case 10 of the present invention. The user selects a desired power and style and removes the hanger system 10 from the rack. The flexible strip 26 allows the user to open the temple arms 30, 32 and try on the glasses with the case 38 and hanger 12 remaining attached to the non-prescription reading glasses 34.

The glasses 34 may be attached to the flexible strip 26 of the hanger 12 by any suitable means known in the art. In the preferred embodiment shown in the drawings, one of the arms 30 is weaved through two holes in the flexible strip 26. The arm 30 is first inserted through a preferably round aperture 30 and then threaded back through a rectangular aperture 46. See FIG. 6. The round aperture 42 is slid up until it meets the glasses hinge 44. See FIGS. 1, 2 and 5.

Preferably, the case 38 is held to the hanger 12 by a fastener such as a staple 48. However, other devices can be used to attach the case to the hanger (for example, even the drawstring 50 of the case 38 would operate effectively.

Preferably, a top aperture 50 for receiving a hook, located adjacent to the top edge 18 of the hanger, is provided. Preferably, this aperture 50 is located generally midway between the two side edges 22, 24 for proper balance.

Figure 8:
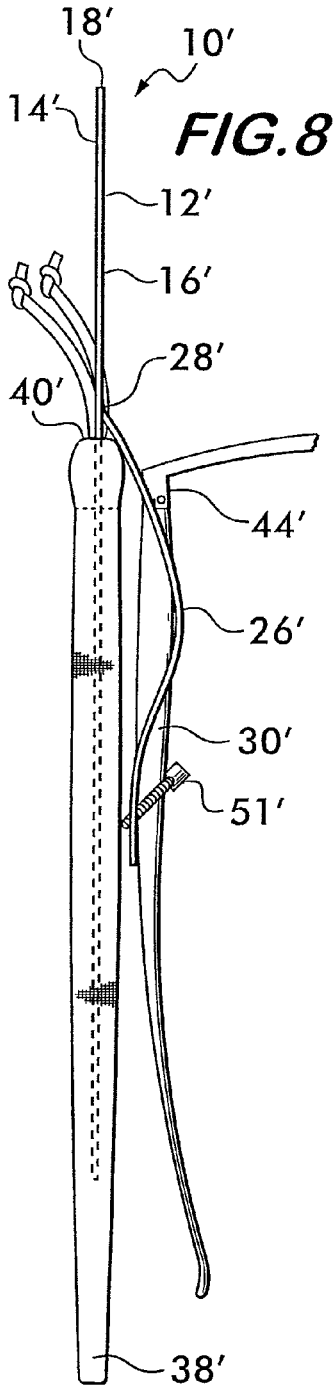
FIG. 8 is a side, elevation view of a display hanger system for non-prescription reading glasses in accordance with an alternate embodiment of the present invention, shown having the glasses and case attached thereto.
Figure 9:
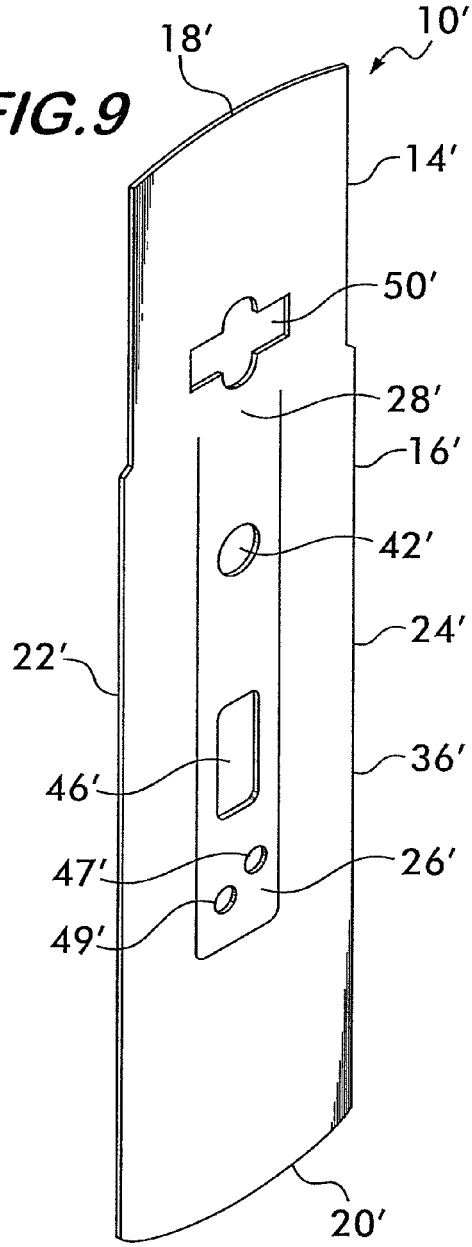
FIG. 9 is an isometric view of a display hanger of the display hanger system for non-prescription reading glasses of FIG. 8.
Figure 11:
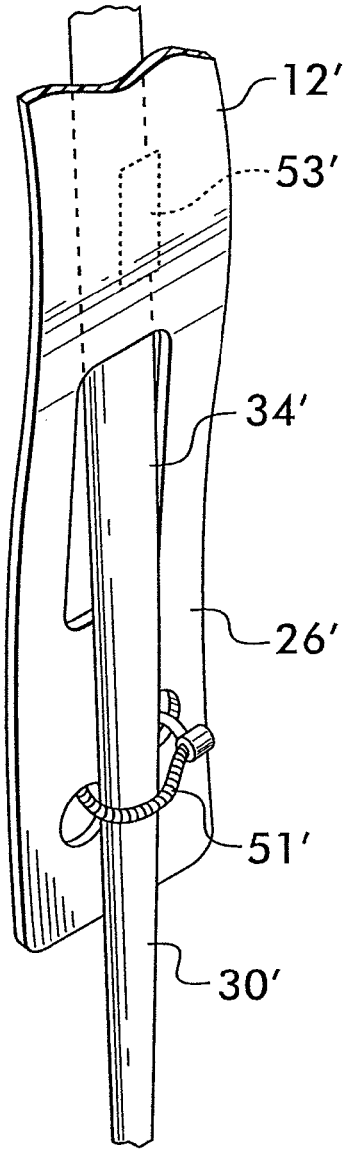
FIG. 11 is a partial isometric detail view of a portion of the display hanger of FIG. 8, shown having a temple arm of a pair of glasses secured with a tie wrap.

Shown in FIGS. 8-9 and 11, is a hanger system 10' for holding a pair of glasses and a case in accordance with a second preferred embodiment of the present invention. The hanger system 10' includes is substantially the same as that of the hanger system 10, but has one important additional feature. For ease of understanding the present invention, the reference numbers used in the embodiment of FIGS. 1-7 are used in the embodiment of FIGS. 8-9 and 11. However, a prime symbol (') has been added for clarity. For example, the hanger system 10 of the embodiment of FIGS. 1-7 is referenced hanger system 10' in the embodiment of FIGS. 8-9 and 11.

Figure 10:
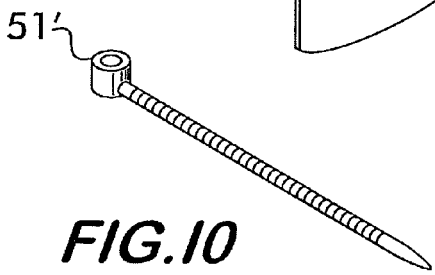
FIG. 10 is an isometric view of a standard tie wrap for use with the display hanger of FIG. 8.

The hanger system 10' of the embodiment of FIGS. 8-9 and 11 includes one small, but important feature. Specifically, two apertures 47', 49' are added to the flexible strip 26' to support a fastener such as the standard tie wrap 51' as shown in FIG. 10. As can best be seen in FIGS. 8 and 11, the tie wrap 51' is threaded through the two apertures 47', 49' and then locked in place to itself. This accomplishes important functions. First, and most important, since an arm 30' of the pair of glasses 34' is now "locked" to the hanger 12', the glasses 34' and hanger 12' remain as a single unit. This allows store personnel to easily monitor sales racks to determine whether customers have returned the hanger system 10' (including hanger 12' and glasses 34') to the display rack in a proper position (based on glasses strength). A customer typically would require the use of scissors or a knife to remove the glasses 34' from the hanger 12'. Therefore, the use of the tie wrap 51' through the two apertures 47', 49' is a substantial deterrent to such a removal.

Additionally, since the tie wrap 51' combined with the hanger 12' create a single, substantially inseparable unit (absent the use of scissors or a knife), an electronic security tag 53' (for example, an EAD or RFID tag) may be more effectively used where the security sticker is attached to the hanger 12'.

While the embodiment shown in the figures depicts the two apertures 47', 49' as being circular, substantially any shape aperture could work conceivably operate effectively. Moreover, while a plastic tie wrap is shown for use with a pair of apertures, many other fasteners could operate effectively, such as a wire tie, rubber band, adhesive, or the like.

Figure 12:
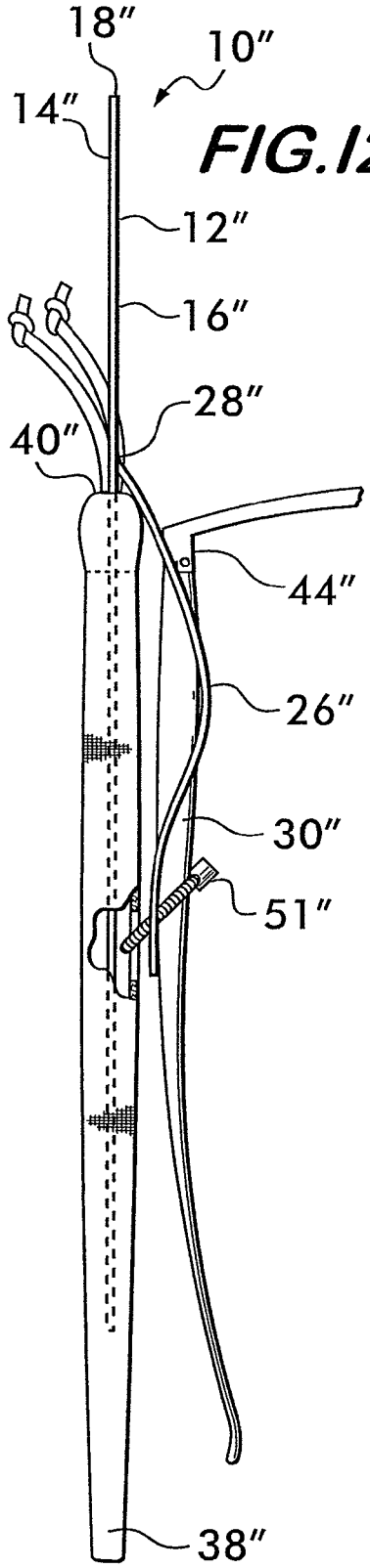
FIG. 12 is an isometric view of a display hanger system for non-prescription reading glasses in accordance with an second alternate embodiment of the present invention, shown having the glasses and case attached thereto.
Figure 13:
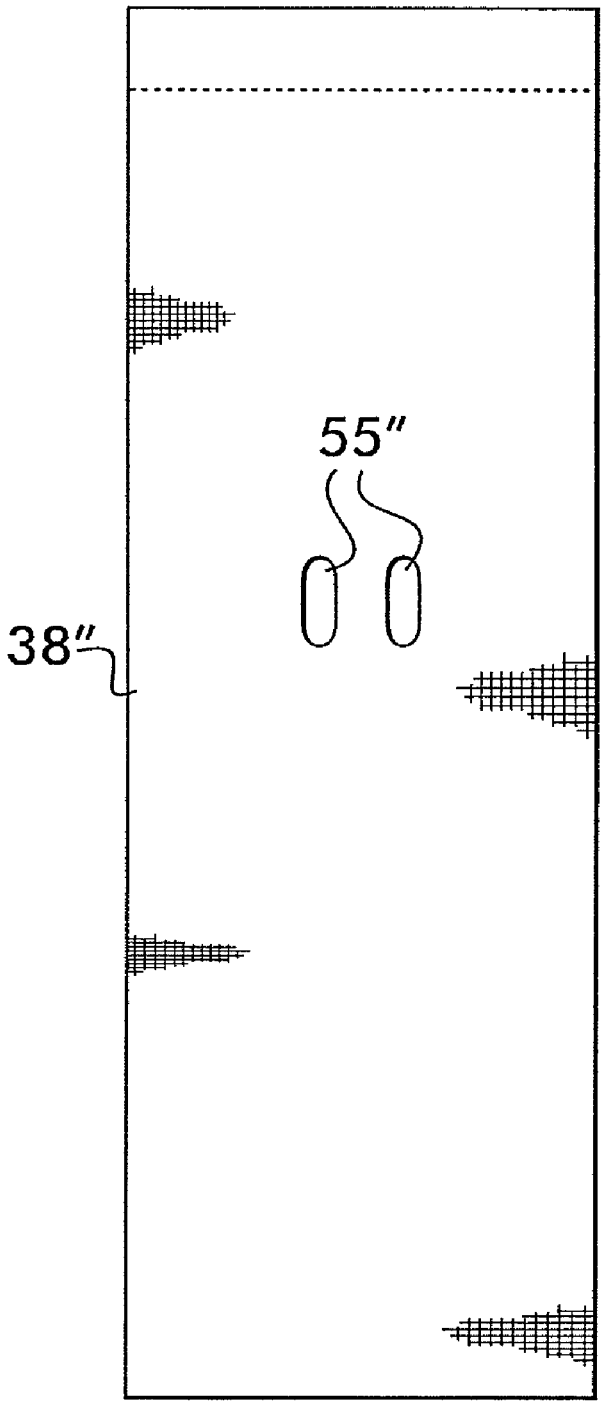
FIG. 13 is a front view of a case for use with the display hanger system of FIG. 12.

Shown in FIGS. 12 and 13, is a hanger system 10" for holding a pair of glasses and a case in accordance with a third preferred embodiment of the present invention. The hanger system 10" includes is substantially the same as that of the hanger system 10', but has one important additional feature. For ease of understanding the present invention, the reference numbers used in the embodiment of FIGS. 1-7 are used in the embodiment of FIGS. 12-13, a double prime symbol (") has been added for clarity. For example, the hanger system 10 of the embodiment of FIGS. 1-7 is referenced hanger system 10" in the embodiment of FIGS. 12-13.

The hanger system 10" of the embodiment of FIGS. 12-13 includes feature that is different than that of the embodiment of FIGS. 8-9 and 11. Specifically, the two apertures are added to the flexible strip 26' to support a fastener such as the standard tie wrap 51' (as was shown in FIG. 10). Additionally, as was shown in the embodiment of FIGS. 8 and 11, the tie wrap is threaded through the two apertures and then locked in place to itself. However, as can be seen in FIGS. 12-13, the tie wrap 51" is also threaded through apertures 55" in the case 38". Therefore, the case 38" is secured to the hanger 12" and the pair of glasses 34" such that they are effectively inseparable until after purchase. The staple 48 of the embodiment of FIGS. 1-7 is not necessary in this embodiment.

While the invention has been described in detail and with reference to specific examples thereof, it will be apparent to one skilled in the art that various changes and modifications can be made therein without departing from the spirit and scope thereof.

What is claimed is:

1. A hanger system and a pair of glasses having a frame having a pair of arms, and a case, comprising:

(a) a hanger constructed from a thin web, said hanger comprising:

(i) a main body having a top edge, a bottom edge and two side edges; and (ii) a flexible strip integral to the thin web, the flexible strip located generally midway between the two side edges and connected to the main body at a hinge point, the flexible strip adapted to flex away from the main body at the hinge point, the flexible strip connected to an arm of the pair of glasses with a fastener;

(b) a portion of the main body slidably engaging the case, wherein the main body is located substantially inside the case and the flexible strip is flexed away from the main body at the hinge point and located outside the case, an upper edge of the case located generally at the hinge point;

whereby the pair of arms of the frame is openable to accommodate a user trying on the pair of glasses with the case remaining attached to the pair of glasses by the hanger.

2. The hanger system and pair of glasses and a case of claim 1, wherein the flexible strip has an upper aperture and a lower aperture for receiving one of the pair of arms.

3. The hanger system and pair of glasses and a case of claim 1, wherein the case is attached to the main body of the hanger by a fastener.

4. The hanger system and pair of glasses and a case of claim 3, wherein the fastener is a staple.

5. The hanger system and pair of glasses and a case of claim 1, including a top aperture for receiving a hook, located adjacent to the top edge and generally midway between the two side edges.

6. The hanger system and pair of glasses and a case of claim 1, wherein the case comprises a bag constructed from a flexible material.

7. The hanger system and pair of glasses of claim 1, wherein the flexible strip is connected to an arm of the pair of glasses with a fastener comprising a tie wrap, wherein the tie wrap is wrapped around the arm of the pair of glasses and is attached using two apertures in the flexible strip.

8. The hanger system and pair of glasses of claim 1, wherein the hanger has a security tag attached thereto.

9. In combination, a hanger, a pair of glasses having a frame having a pair of arms, and a case, the hanger for holding the pair of glasses, comprising:

(a) a thin web having a main body having a top edge, a bottom edge and two side edges; and (b) a flexible strip integral to the thin web, the flexible strip located generally midway between the two side edges and connected to the main body at a hinge point, the flexible strip adapted to flex away from the main body at the hinge point, the flexible strip adapted to attach to the arm of the pair of glasses, the flexible strip connected to the arm of the pair of glasses with a fastener;

(c) a portion of the main body adapted to slidably engage the case, wherein the main body is located substantially inside the case and the flexible strip is flexed away from the main body at the hinge point and located outside the case, an upper edge of the case located generally at the hinge point;

whereby, in use, the pair of arms of the frame is openable to accommodate a user trying on the pair of glasses with the case remaining attached to the pair of glasses by the hanger.

10. The combination of the hanger, the pair of glasses having a frame having a pair of arms, and the case of claim 9, wherein the flexible strip has an upper aperture and a lower aperture for receiving one of the pair of arms.

11. The combination of the hanger, the pair of glasses having a frame having a pair of arms, and the case of claim 9, including a top aperture for receiving a hook, located adjacent to the top edge and generally midway between the two side edges.

12. The hanger, the pair of glasses having a frame having a pair of arms, and the case of claim 9, wherein the flexible strip is connected to one of the arms of the pair of glasses with a fastener comprising a tie wrap, wherein the tie wrap is wrapped around the arm of the pair of glasses and is attached using two apertures in the flexible strip.

13. The hanger, the pair of glasses having a frame having a pair of arms, and the case of claim 12, wherein the flexible strip is connected to one of the arms of the pair of glasses and the case with a fastener.

14. A hanger system and a pair of glasses having a frame having a pair of arms, and a case, comprising:

(a) a hanger constructed from a thin web, said hanger comprising:

(i) a main body; and (ii) a flexible strip integral to the thin web, the flexible strip connected to the main body at a hinge point, the flexible strip adapted to flex away from the main body at the hinge point, the flexible strip connected to an arm of the pair of glasses, wherein the flexible strip is connected to an arm of the pair of glasses with a fastener;

(b) a portion of the main body slidably engaging the case, wherein the flexible strip is flexed away from the main body at the hinge point and located outside the case;

whereby the pair of arms of the frame is openable to accommodate a user trying on the pair of glasses with the case remaining attached to the pair of glasses by the hanger.

15. The hanger system and a pair of glasses of claim 14, wherein the flexible strip is connected to an arm of the pair of glasses with a fastener comprising a tie wrap, wherein the tie wrap is wrapped around the arm of the pair of glasses and is attached using two apertures in the flexible strip.

16. The hanger system and a pair of glasses of claim 14, wherein the flexible strip is connected to both an arm of the pair of glasses and the case with a fastener.

17. The hanger system and a pair of glasses of claim 16, wherein the flexible strip is connected to an arm of the pair of glasses with a fastener comprising a tie wrap, wherein the tie wrap is wrapped around the arm of the pair of glasses and is attached using two apertures in the flexible strip and wherein the tie wrap also is attached to the case with two apertures in the case.

18. The hanger system and pair of glasses of claim 14, wherein the hanger has a security tag attached thereto.

* * * * *